US009777482B1

(12) United States Patent
Saleh et al.

(10) Patent No.: US 9,777,482 B1
(45) Date of Patent: Oct. 3, 2017

(54) RESIDENTIAL OR COMMERCIAL SEE-THROUGH EAVES AND DOWNSPOUT GUTTER SYSTEM

(71) Applicants: Nabil Saleh, Toronto (CA); Kirill Kim, Toronto (CA)

(72) Inventors: Nabil Saleh, Toronto (CA); Kirill Kim, Toronto (CA)

( * ) Notice: Subject to any disclaimer, the term of this patent is extended or adjusted under 35 U.S.C. 154(b) by 0 days.

(21) Appl. No.: 15/333,978

(22) Filed: Oct. 25, 2016

(51) Int. Cl.
*E04D 13/064* (2006.01)
*E04D 13/076* (2006.01)
*E04D 13/072* (2006.01)
*E04D 13/08* (2006.01)

(52) U.S. Cl.
CPC ..... *E04D 13/064* (2013.01); *E04D 13/076* (2013.01); *E04D 13/0725* (2013.01); *E04D 2013/0833* (2013.01); *E04D 2013/0866* (2013.01)

(58) Field of Classification Search
CPC ..... E04D 13/0645; E04D 13/064; E04D 13/0722; E04D 13/08; E04D 13/0833; E04D 13/084
USPC ..... 52/11, 12, 16
See application file for complete search history.

(56) References Cited

U.S. PATENT DOCUMENTS 3,465,885 A * 9/1969 Trump ..... E04D 13/08 210/447
4,169,570 A * 10/1979 Morin ..... E04D 13/0725 248/48.2
5,452,546 A * 9/1995 Goddard ..... E04D 13/08 210/170.03
5,882,508 A * 3/1999 St-Jacques ..... E03F 1/002 210/170.01
7,493,728 B2 * 2/2009 Dussault ..... E03B 3/03 137/357
8,069,617 B2 * 12/2011 Wootton ..... E04D 13/064 210/474
2003/0051414 A1 * 3/2003 Bessette ..... E04D 13/08 52/16
2004/0040219 A1 * 3/2004 Bacik ..... E04D 13/064 52/11
2008/0229673 A1 * 9/2008 LaMorte ..... E04D 13/08 52/12

FOREIGN PATENT DOCUMENTS

DE 2941202 A1 * 4/1981 ..... A01G 9/1476
FR 2913437 A1 * 9/2008 ..... E04D 13/08
GB 2358886 A * 8/2001 ..... B01D 29/03
JP 05272202 A * 10/1993

* cited by examiner

*Primary Examiner* — Adriana Figueroa
(74) *Attorney, Agent, or Firm* — Onello & Mello, LLP

(57) ABSTRACT

The present invention is a gutter system with a transparent eavestrough and a transparent downspout that allow for the monitoring of the rainwater flow and debris in the gutter and downspout system in a building or a house. This gutter system can provide a continuous monitoring of the gutter and downspouts to detect the exact spot of debris collected therein for the purposes of readily predicting and cleaning the system or repairing and preventing debris blockage in the flow of rainwater runoff and preventing the unnecessary cleaning of the downspout and removal of debris to eliminate homeowners cost.

19 Claims, 8 Drawing Sheets

RESIDENTIAL OR COMMERCIAL SEE-THROUGH EAVES AND DOWNSPOUT GUTTER SYSTEM

FIELD OF THE INVENTION

The present invention relates in general to gutter systems and, in particular, to a see-through monitoring system for gutters and downspouts.

BACKGROUND OF THE INVENTION

Roofs are usually equipped with gutter system. These systems typically each comprise of a horizontal gutter trough, open at its upper end, running along the edges of the roof of a building. The gutter collects the rain water from the roof and redirects it into a vertical downspout that directs the collected rainwater into a desired channel or drainage area away from the building.

One of the main issues with the presently available gutter systems is that they are exposed to debris, such as leaves, roofing material, sticks, animal dirt, and other objects. The debris collects in the gutter system and may block the flow of the water. Blockage tends to occur within the gutters, around the spikes or hangers, in the bends or elbows of the gutters, in the downspout system and in other areas.

A blockage of debris collected within the gutter system will cause a backup of water to overflow instead of running down the downspout. The excess water will then pour over the edges of the horizontal gutters. This will cause the water to run down the sides of the house damaging the sidings and catching the homeowner completely by surprise as he/she was not aware of the problem building up in the first place, when it could have been easily prevented (with our system). This backup causes a number of serious problems. For example, water may leak into the home from the sides of the house or from the frame of the windows (usually where the caulking is applied around the casing of the window), which can cause internal molding and other damages which leads to thousands of dollars in repairs. The overflow of water may also damage the covering materials of the home such as bricks, stucco or siding.

The blockage in the gutter system may also cause serious damage to the foundation of the building because the overflow of water from the walls may trickle into the ground surrounding the house and cause cracks in the foundation of the home. Therefore, gutters must be periodically cleaned to prevent serious damage to the home. The conventional method of eavestrough and downspout cleaning/repairs and with the way the industry is shaped today has costed homeowners thousands of dollars either due to being scammed into paying for a cleaning that was not done or paying for an eavestrough cleaning/repair that was not needed (examples are explained below).

The problem with today's eavestroughs and downspouts is that homeowners have zero knowledge of the physical/internal state of their gutters or downspouts. This leaves them vulnerable to many things.

A homeowner may ask for their eaves or downspouts to be cleaned and call on a professional to take on that task (usually it is done 1-2 times a year at an average cost of CDN$150-200 dollars for each cleaning), generally how this industry is run is that a professional will show up to the house set-up the ladder and get onto the roof. The professional will then proceed to "clean" the gutters (a complete gutter cleaning should take about 2.5-3 hrs including the downspouts) and once finished, invoice the customer for the service. The common problem that homeowners face in this situation is the inability to tell if the job was completed or not besides taking the word of the cleaner on-site. As the inventor is a former gutter and downspout cleaner of 5 years, he estimates that 9 times out of 10 the cleaner on-site either did a very poor job by collecting only a small fraction of debris from the eavestrough and showing it to the customer as evidence of a complete job while the job has not been fully completed, or the job has not been done at all. The customer is charged the full amount for a complete gutter cleaning without the customer checking for results. Due to the level of heights involved with gutter cleaning/repairing the homeowner is forced to take the cleaner/technicians word that the cleaning is fully completed. This leaves homeowners and their houses very vulnerable and prone to damages. Un-cleaned gutters and downspouts can cause huge problems for homeowners down the line. For example, un-cleaned gutters means there is still debris left in the gutters. The amount of weight a gutter can sustain is limited before the hangers dislodge from the home and start to hang off. To repair damaged gutters would cost the homeowner thousands of dollars in repairs, all because debris was not removed during the original cleaning and eventually over time more debris accumulated thus causing damages.

Another issue with the conventional gutter and downspout system is if a homeowner notices an overflow of water their first intention is to get the problem solved. So the homeowner calls on a professional to service them. The professional comes to the home, gets on the roof and offers a quote. Without the homeowner having knowledge of what's going on in the gutter or downspout the homeowner is in yet another vulnerable position as he or she wants the problem fixed immediately and is willing to take the word of a professional. This is where the professional takes full advantage of the homeowner, charging top dollar for an overflow issue that could be for something as small as a bird nest being stuck in the gutter or downspout. Had the homeowner been aware of the issue at hand and been able to see how their eaves or downspouts look, this would have helped the homeowner to avoid a pricey fix and to obtain a more ACCURATE quote, or if handy enough the homeowner could have easily resolved the issue themselves and saved the CDN$400-800 dollar repair.

Traditional gutters and downspouts constrict the homeowner from knowing the condition their gutters or downspouts are in. In some cases the homeowner will pay to have the gutters or downspouts cleaned once or twice a year either because they want to protect the investment in their home, because they were convinced by an eavestrough company to get the job done, or any other reason. Often times an eavestrough may be completely empty and, with no knowledge of how their eaves or downspouts look, the homeowner will spend a few hundred dollars to get the cleaning done when their eaves or downspout may not need it in the first place.

These along many other problems are what homeowners face with the conventional gutter and downspout system. The conventional downspout system comprises of a series of elbows and adaptors which help direct and guide the flow of water and minor debris from the eavestrough to either the sewage line or lawn. When the water or debris passes through the conventional downspout system the elbow adaptors of the downspouts are highly prone to debris clogging as that is where the bend occurs in the downspout system. The bend is susceptible to this issue because of the ability for the debris to sit on the corner of the elbow thus causing the elbow to become clogged. Traditional methods of unclogging an elbow would be to un-assemble the downspout system which would cost a homeowner their time (a professional takes about 2 hrs and a homeowner takes upwards of 3-4 hrs), money and a ton of headaches. The inventor's approach to this issue resolves all headaches and saves the customer time and money. Not to mention that if the customer chooses to hire a professional to take on the problem the professional will have a much smoother job unclogging the elbows and in turn could potentially offer a cheaper quote to the customer thus saving them money.

Prior art has attempted to solve the problems in gutter systems by using debris collection devices (located at the bottom of the downspout, the spot least prone to getting clogged), and gutter cleaning systems. Also, filters are used to prevent the blockage of the gutter system by capturing the debris flowing through the gutter system (the method of placing a filter at the top of the downspout has proved to do more harm than good and is a very simple way for clogging and backups to occur). The prior art discloses a wide variety of gutter systems with various structures in order to direct the rainwater away from a roof of a house or other building structure, but the prior art systems have not helped solve the problems stated above. However, most conventional gutter systems still have an open top, which can become clogged by leaves or other debris. Gutter systems with covers, such as screens to reduce clogging, have also been disclosed but these designs have become very faulty and can also clog over time and have not yet improved the gutter and downspout industry.

SUMMARY OF THE INVENTION

The present invention provides a residential/commercial gutter system that allows for monitoring of the flow of the rainwater, and buildup of debris in the gutter and downspouts of the system. This gutter system can provide continuous monitoring of the gutter and downspouts to detect the exact spot where debris is collected therein for the purpose of predicting and cleaning blockages in the gutter and downspouts, as well as keeping a homeowner aware of the condition their eaves or downspouts are in.

The present gutter and downspout system has a plurality of strategically positioned transparent strips to allow for visual inspection of the flow inside the system. The eavestrough and downspout may be designed from a completely transparent material, or from a mixture of solid and transparent materials. For example, in an embodiment of the present invention there are transparent strips longitudinally provided on the sides of the downspout as well as on the upper lip and bottom of the gutter. This provides a gutter system that avoids the unnecessary cleaning of the eavestrough and downspout and removal of debris from the gutters to eliminate the cost for cleaning for the homeowner while keeping the view of the house aesthetically pleasing. It serves the purpose of informing homeowners as to when a cleaning is due (e.g., once debris has reached the upper lip of the gutter (as stated above) the homeowner recognizes that the gutter system is now due for a cleaning thus steering them away from faulty cleans, unnecessary cleans, and ensuring their gutters are in an optimal state). The transparent strips allow homeowners to have a clear view of their gutter and downspout system, keeping them aware about the system and protecting them from the vulnerable positions stated above (in the background of the invention section).

A gutter system usually comprises a horizontal gutter and a vertical downspout. The gutter system can be configured proximate to a structure, such as a residential house or building, with an extended surface located above the gutter system, such as a roof. The gutter system can extend longitudinally, along and below the roof to allow rainwater or debris to flow from the roof and into the gutter and eventually down the downspout. The gutter system can be installed with a slight downward slope, to allow it to receive rainwater from the roof and direct rainwater toward the downspout. The debris collected in the gutter system can be monitored through the transparent structure of the gutter system. The blockage area can be discovered and cleaned by the homeowner or by a specialist to prevent destruction of the whole system. The gutter system of the present invention will also be reinforced and held up by elongated brackets or hangers, which help resolve common problems with today's eavestrough system that compromise thin brackets that only hold up every one and a half feet of the gutter. Our elongated brackets or hangers will be installed at every one and a half feet but have the feature of an elongated front hook that serves to hold up and reinforce more of the gutter thereby eliminating any sagging, or dislodging from the buildup of debris or rainwater.

The gutter system of the present invention provides elbows in connection points of the downspout.

The downspout elbows have an access point to allow access to the elbow that may be clogged (as the elbows errors and grammar, and of a downspout are the most prone to clogging), and can be easily cleaned by the homeowners. The access point has a cap that can be fastened on the access point, by a fastening means and can be easily removed for cleaning purposes (e.g., a simple twist-on and twist-off method, like opening a bottle cap).

The gutter system further comprises of easy to assemble features. For example, one side of the downspout will have a female adapter while the other side has a male adapter, which allows the downspouts to be easily screwed together to facilitate an easy set-up/disassembly process, or two male adapting sides with a middle component connecting the two.

One object of the present invention is to give the homeowners a clear view of the eavestroughs and downspouts and prevent any blockage.

It is another object of the present invention is to prevent unnecessary gutter cleaning and save the homeowners unnecessary expenses.

It is another object of the present invention is to monitor and control the gutter cleaning companies, which may charge the homeowner for a cleaning that is not performed.

It is another object of the present invention to allow the homeowner to pinpoint the issue accurately, and to proceed from the blockage point, and to prevent the destruction of the whole gutter system. This method also offers the benefit of receiving a more accurate quote from a professional if the homeowner decides to get the issue resolved by a third party, which in turn saves the homeowner money.

It is another object of the present invention to enable the homeowners to get a clear view of the gutter and downspout while maintaining an aesthetically pleasing look to their home.

It is another object of the present invention to provide a gutter system with elbows with access points facilitating for easy cleaning of the elbows. Elbows are highly prone areas for clogging within the downspouts.

It is another object of the present invention to provide a gutter system for achieving early detection of a blockage before it becomes completely backed-up.

It is another object of the present invention to provide added reinforcement with elongated gutter brackets/hangers that avoid the common problem of sagging or dislodging of the gutter that occurs from the accumulation of rainwater or debris.

It is another object of the present invention to provide a gutter system that can allow a homeowner to easily observe the water flow and detect the point of blockage in the gutter system, and to prepare a repair plan.

These objects, as well as other objects and advantages will become more apparent in the description that is set forth herein below, particularly when read in conjunction with the accompanying drawings.

BRIEF DESCRIPTION OF THE DRAWINGS

Embodiments herein will hereinafter be described in conjunction with the appended drawings provided to illustrate and not to limit the scope of the claims, wherein like designations denote like elements, and in which:

The figures are not intended to be exhaustive or to limit the present invention to the precise form disclosed. It should be understood that the invention can be practiced with modification and alteration, and that the disclosed technology be limited only by the claims and equivalents thereof.

DETAILED DESCRIPTION OF PREFERRED EMBODIMENTS

The technology disclosed herein, in accordance with one or more various embodiments of the present invention, is described in detail with reference to the figures described herein. The drawings are provided for purposes of illustration only and merely to depict typical or example embodiments of the disclosed technology. These drawings are provided to facilitate the reader's understanding of the disclosed technology and shall not be considered limiting of the breadth, scope, or applicability thereof. It should be noted that for clarity and ease of illustration these drawings are not necessarily made to scale.

Figure 1:
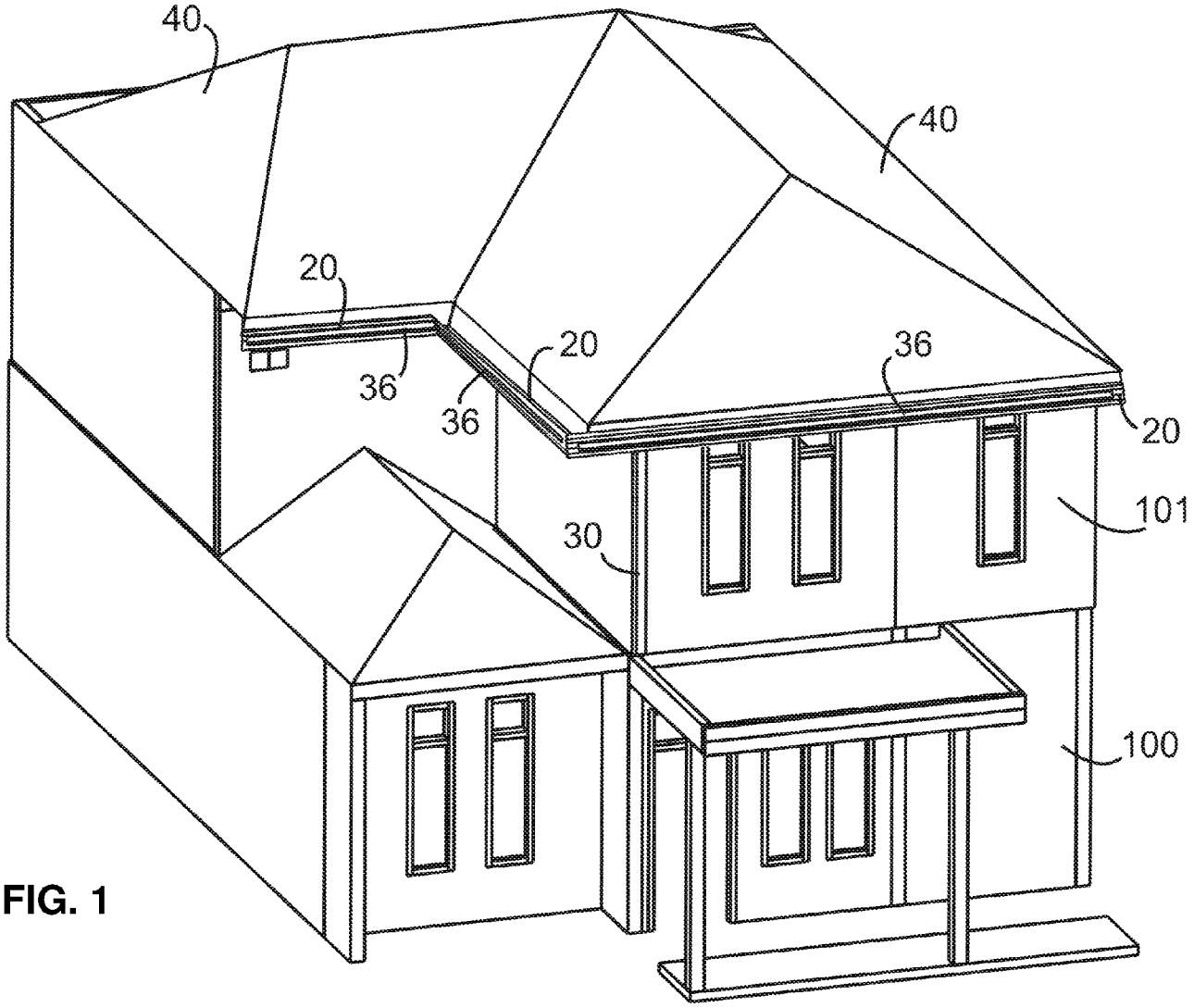
FIG. 1 shows a perspective view of a building with the present invention attached thereto.

FIG. 1 illustrates a perspective view of a building 100 with the present invention. The present invention is a gutter system 10 comprising a horizontal gutter 20 and a vertical downspout 30. The horizontal gutter 20 may be formed in accordance with several profiles and sizes and may extend longitudinally along the lower sides of the roof 40, to allow rainwater to flow from the roof 40 into the gutter 20 whereby rainwater is directed toward downspout 30.

Figure 2A:
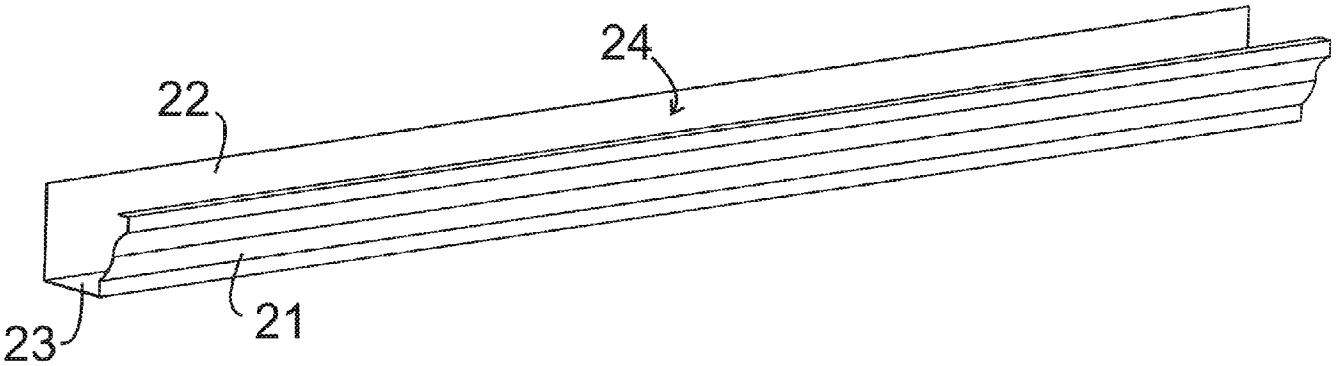
FIG. 2A shows a perspective view of a gutter showing the left side thereof.
Figure 2B:
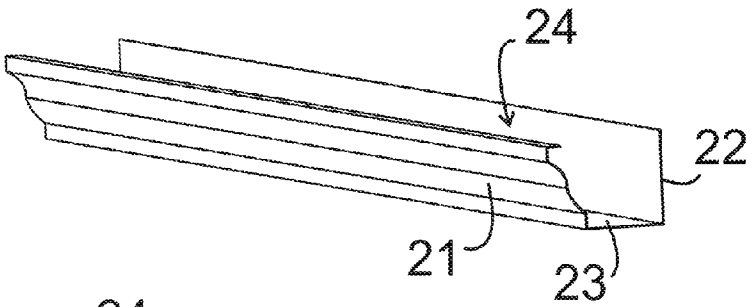
FIG. 2B shows a perspective view of a gutter showing the right side thereof.
Figure 2C:
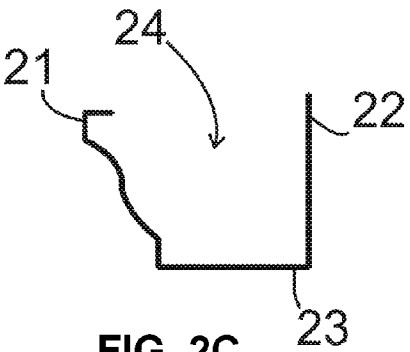
FIG. 2C shows a cross-sectional side view of a gutter.

As shown in FIGS. 2A, 2B and 2C the horizontal gutter 20 comprises a front wall 21, a rear wall 22, and a base 23 that form a channel 24 for receiving and channelling rainwater. The horizontal gutter 20 is configured to attach to and to extend longitudinally along a side wall or fascia of the building or house. The horizontal gutter 20 can be attached to the building 100 with hangers, brackets or other attachment means 60. The examples of the attachment means are shown in FIGS. 6A, 6B and 6C.

Figure 6A:
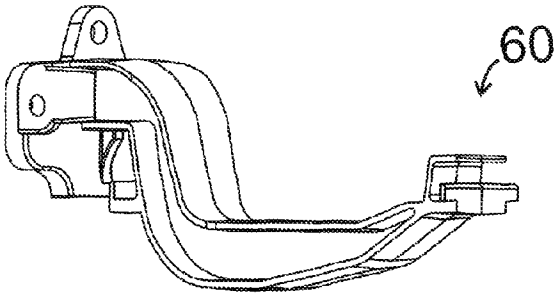
FIG. 6A shows a perspective view of an attachment means.
Figure 6B:
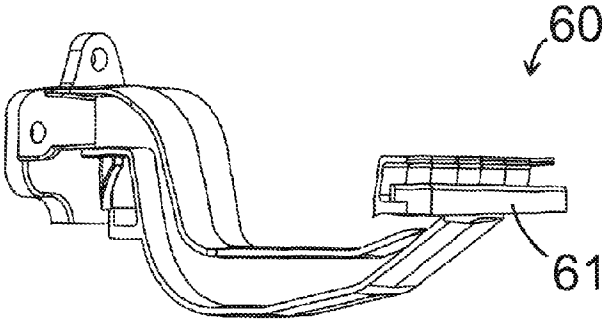
FIG. 6B shows a perspective view of an attachment means incorporating a wider grabbing means.
Figure 6C:
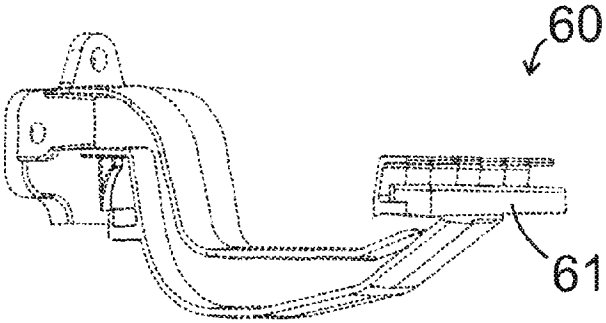
FIG. 6C shows a perspective view of an attachment means that is formed of a transparent material.

Again as shown in FIGS. 6A, 6B and 6C, the attachment means 60 has a means 61 which is grabs the front wall of the gutter. In the present invention, the grabbing means 61 can be designed in such a way that it grabs more area in the front wall as needed for holding the gutter system securely on the building. As shown in FIG. 6C, the attachment means 60 can be completely transparent.

Figures 5A, 5B, 5C:
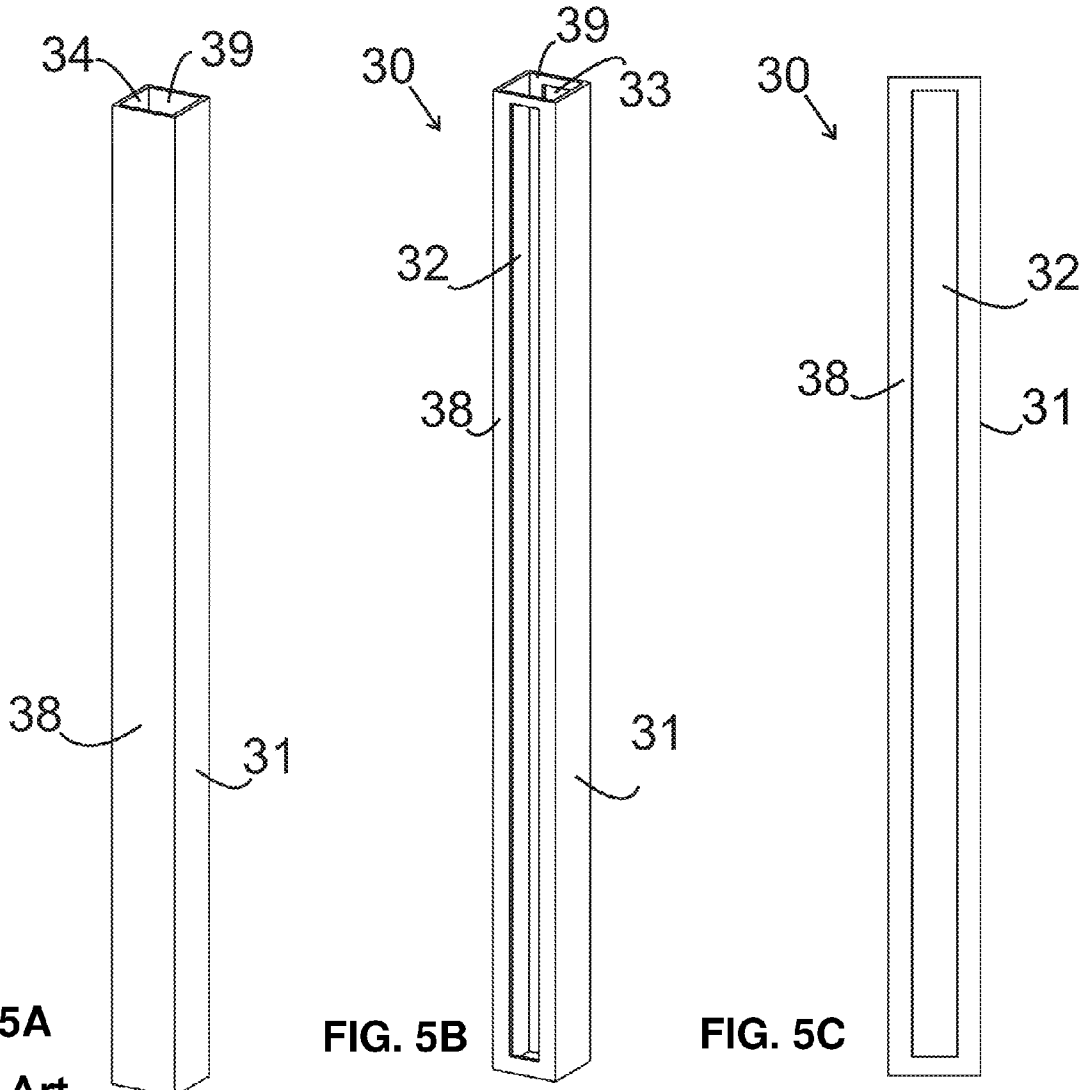
FIG. 5A Prior Art
FIG. 5A shows a perspective view of a prior art downspout.
FIG. 5B shows a perspective view of a downspout incorporating a transparent strip in two side walls.
FIG. 5C shows a side view of a downspout incorporating a transparent strip in a side wall.

Again as shown in FIG. 1, a downspout 30 is a tubular trough positioned vertically on the side wall 101 that directs water flow downward from the horizontal gutter 20. As shown in FIGS. 5A, 5B and 5C a downspout comprises a front wall 31, a left wall 38, a right wall 39 and a rear wall 34, attached to and extending longitudinally along a side wall 101 or fascia of a building 100.

FIGS. 1, 3A, 3B, 3C, 4B, 4C show the gutter system 10 of the present invention. In one embodiment, a transparent strip 36 is incorporated in the front wall 21 at an elevation about 2.5 inches from the base 23 and acts as an indicator for the homeowners monitoring the rainwater flow in the gutter system 10 in a building 100. The transparent strip 36 is longitudinally provided on the front wall 21 of the gutter 20.

Figures 3A, 3B, 3C:
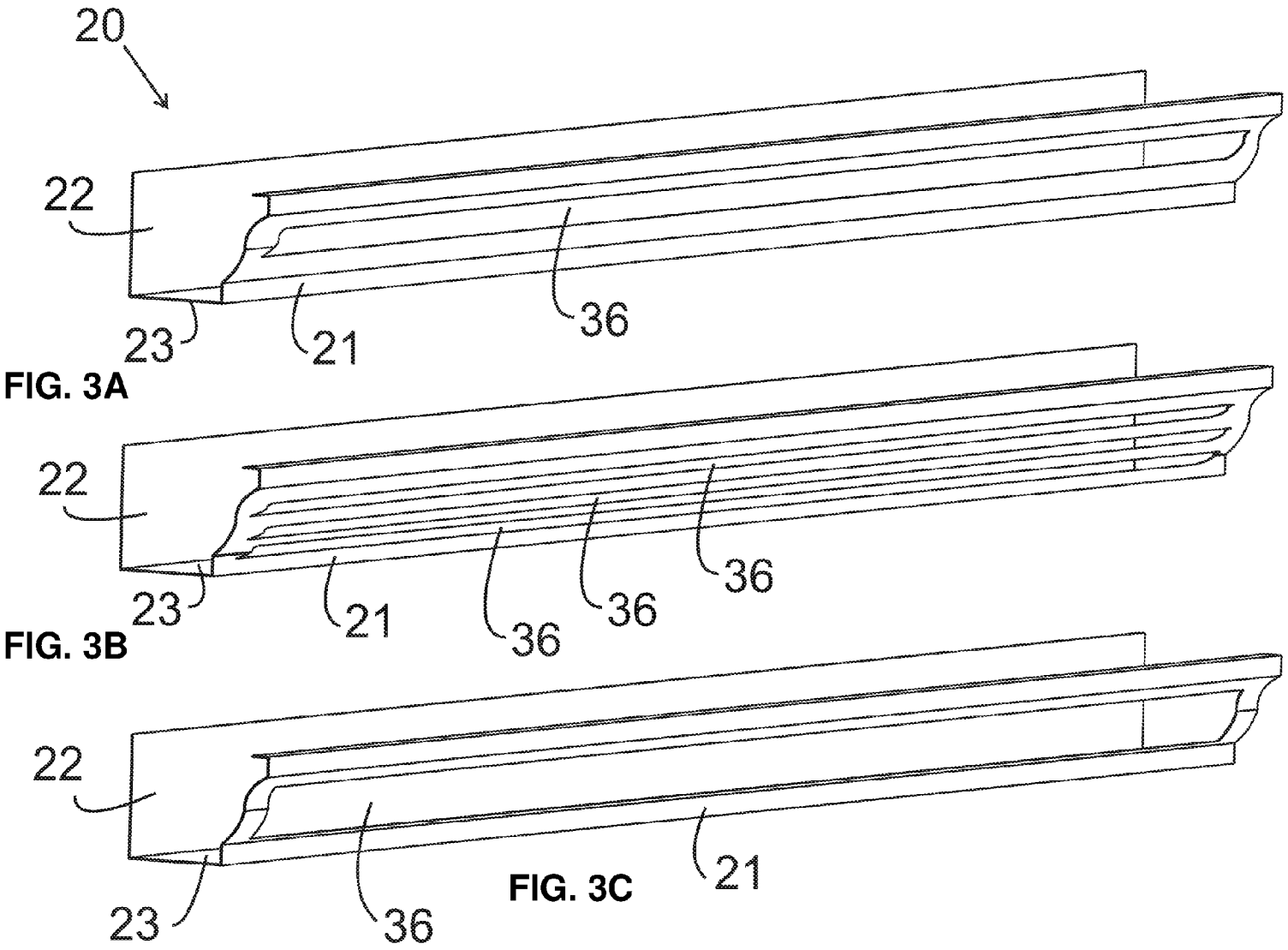
FIG. 3A shows a perspective view of a gutter incorporating a transparent strip.
FIG. 3B shows a perspective view of a gutter incorporating a plurality of transparent strips.
FIG. 3C shows a perspective view of a gutter incorporating a wide transparent strip.

As shown in FIG. 3B, the front wall 21 of the gutter 20 may have a plurality of longitudinal transparent strips 36. This arrangement for the transparent strips, helps homeowners understand the amount of debris inside the gutter 20.

Figure 4A:
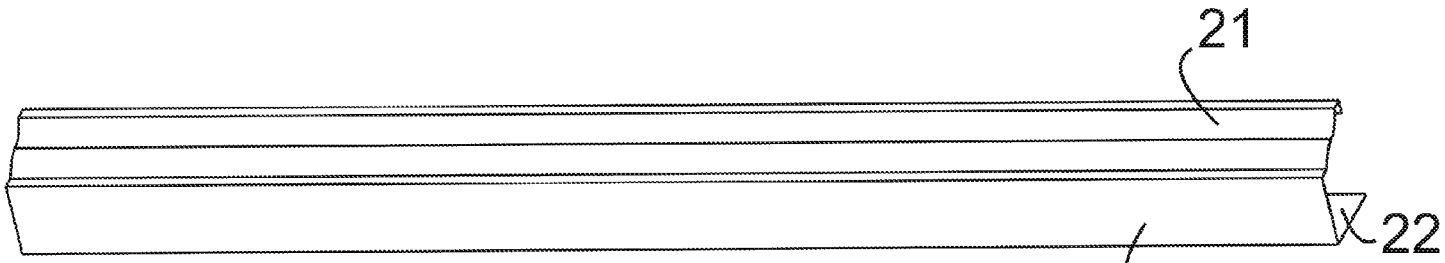
FIG. 4A shows a bottom view of a gutter.
Figure 4B:
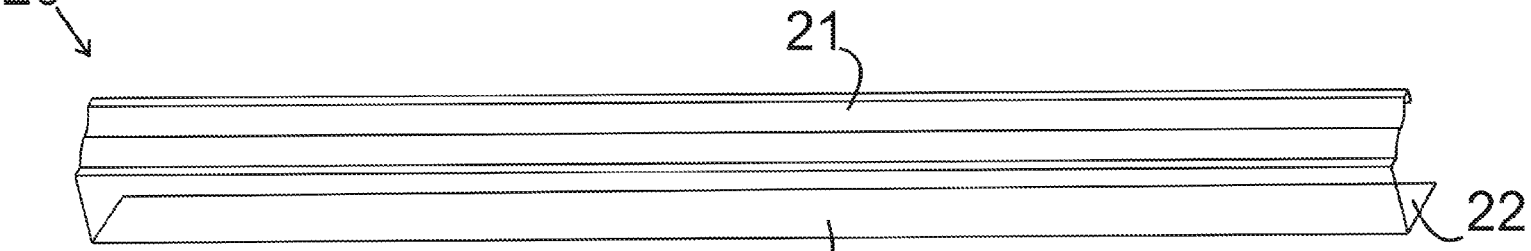
FIG. 4B shows a bottom view of a gutter incorporating a bottom section formed of a transparent material.
Figure 4C:
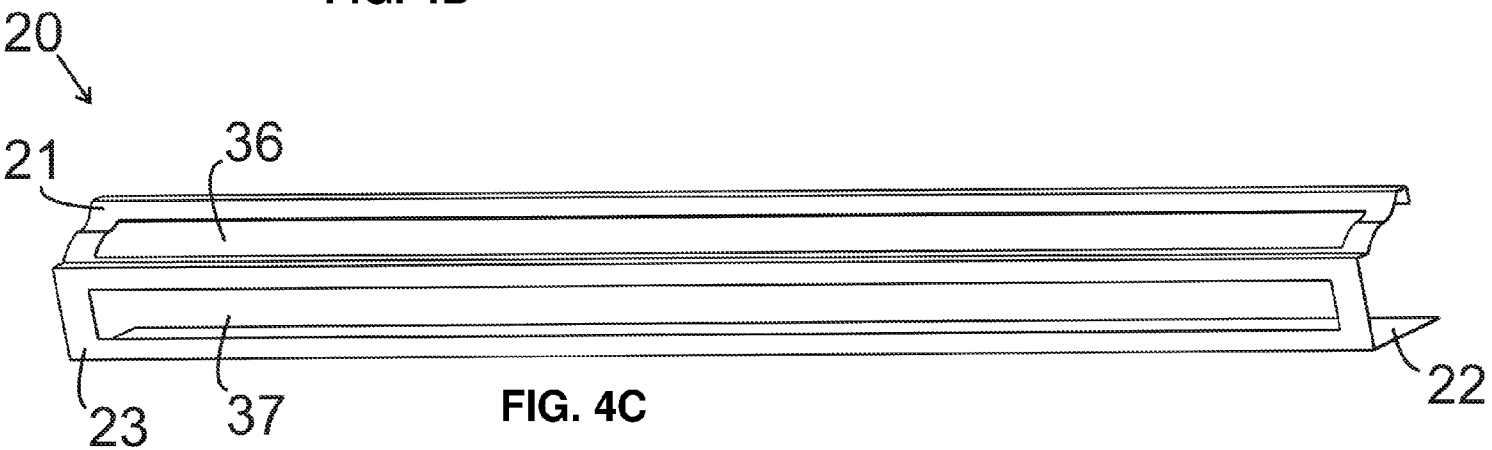
FIG. 4C shows a bottom view of a gutter incorporating a transparent strip in the front wall and the base wall.

As shown in FIG. 4A, the base 23 can be formed of an opaque material, or the whole structure of the gutter system can be made of the opaque material similar to the conventional gutter system in the market. In one embodiment of the present invention, the base 23 can be constructed of a transparent material as shown in FIG. 4B. In this case any blockage in the gutter 20 can be observed by the homeowners and alert them to take an action. In one embodiment of the present invention as shown in FIG. 4C, the horizontal gutter 20 comprises a transparent strip 37 that is longitudinally attached to the base 23. In another embodiment of the present invention, the horizontal gutter 20 can be completely constructed of a transparent material using a variety of methods, such as an extrusion and/or moulding process.

FIG. 5A shows a conventional downspout. FIGS. 5B and 5C show the downspout 30 of the present invention. The downspout 30 of the present invention has at least a transparent strip 32 longitudinally incorporated in the left side wall 38 or a transparent strip 33 incorporated in the right side wall 39. In this case transparent strips 32, 33 are attached/built in longitudinally to the side walls of the downspout 30, extending along the length of the downspout 30. This method will not damage the aesthetic appearance of the building with viewable debris.

In another embodiment of the present invention, the downspout 30 is constructed completely of a transparent material using a variety of methods, such as an extrusion and/or moulding process. In this case any blockage in the downspout can be observed by the homeowners and alert them to take an action.

The gutter system of the present invention can be made of a variety of different materials, such as a plastic, or a metal or an aluminium. The gutter system of the present invention comprises of a transparent material which is sun resistant and capable of withstanding both hot and cold temperatures.

The gutter system of the present invention comprises of a transparent or a see-through structure to provide for visual inspection. Preferred materials are polycarbonates such as Lexan and polyacrylates such as Plexiglas. The gutter system of the present invention can also be made of a glass material. Any glass composition, including specially formulated glass, may be used, such as laminates of glass. In the present invention, a combination of plastic and glass may also be used.

An elbow section is shown in FIGS. 7A, 7B, 7C and 7D. The elbow 50 of the present invention is the most highly prone place for clogging of the debris. The elbow 50 further has a front side 51, a rear side 52, and side walls 53, 54, and are bent at an angle of 45 degrees, or elbows can also come in bends of 90 degrees, 75 degrees, and 45 degrees. The elbow 50 provides an access point 55 to access the elbow 50 interior that may be clogged and can be literally cleaned by the homeowner in a minutes of time. (Prior art methods would require the homeowner to disassemble the entire downspout system to access the clogged areas.) The access point 55 has a cap 56 that can be fastened on the access point 55 by a fastening means and can be removed for cleaning.

Figure 7D:
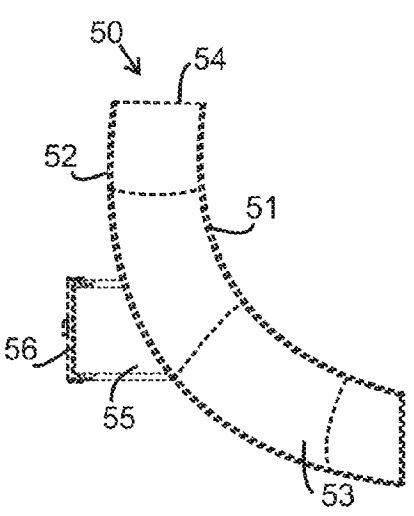
FIG. 7D shows a side view of a elbow section formed of a transparent material.
Figure 7C:
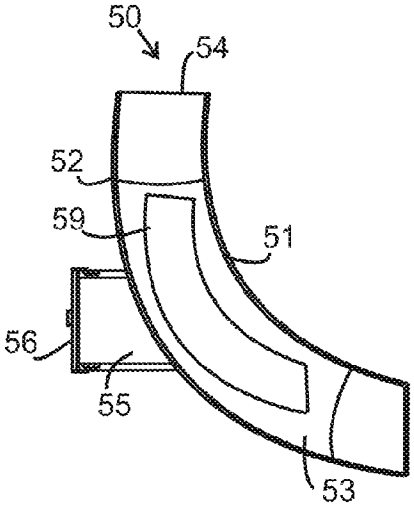
FIG. 7C shows a side view of an elbow section incorporating a transparent strip in a side wall.
Figure 7B:
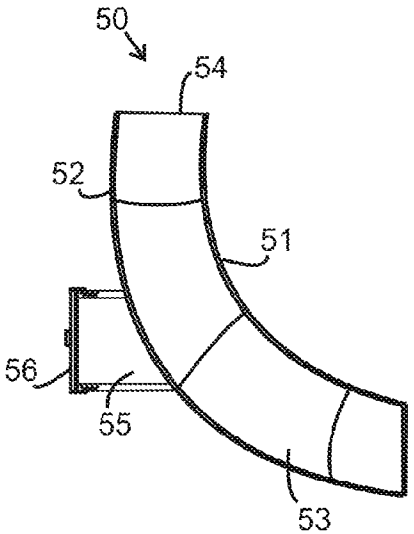
FIG. 7B shows a side view of an elbow section.
Figure 7A:
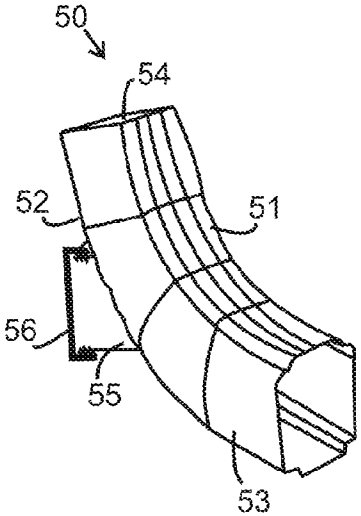
FIG. 7A shows a perspective view of an elbow section.

Again as shown in FIG. 7C, the elbow 50 further has a transparent strip 59 along one or more of the elbow walls 51-54. The transparent strip 59 indicates any clogging by debris inside the elbow 50. In one embodiment of the present invention, the elbow 50 can be formed of a transparent material.

Figure 8:
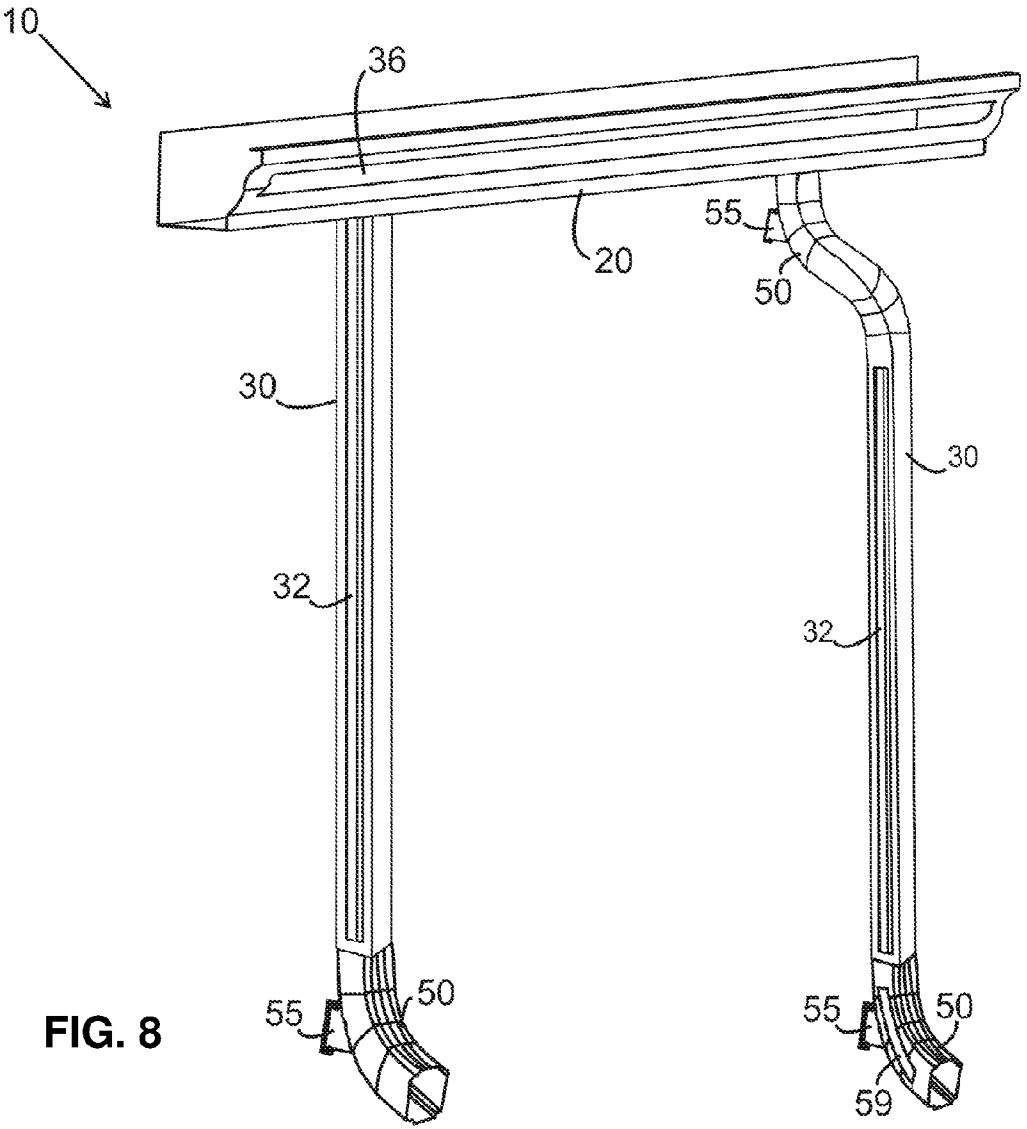
FIG. 8 shows a perspective view of the gutter system incorporating a plurality of downspouts attached to a gutter.

Cleaning the gutters and downspouts in a conventional method can take up to several hours, which requires errors and grammar, and the use of special tools/calling on a professional. If the debris has clogged the horizontal gutter 20 or downspout 30, as shown in FIG. 8, the homeowner now has a clear view to where the problem lies. If the homeowner chooses to hire a professional to take on the issue the homeowner now has the confidence of knowing the job will be done to satisfaction and the homeowner will be charged the correct amount for the services rendered. The system can be viewed through the transparent strip 32, and can be cleaned without disassembling the whole downspout system 30. The homeowner can view the blocked area and access the point through the access point 55 of the elbows 50 and clean the blocked area.

The gutter system of the present invention may attach along a house's eaves by any of several means, including straps, brackets, and hangers. The brackets can be adapted to be secured to the side wall of a building/house underneath the eaves of a roof and connected to fascia board of a home. A plurality of brackets and hangers can be spaced along the gutter to support the gutter system (roughly every 2-3 feet). The brackets of the present invention can comprise brackets formed of transparent materials or errors and grammar, and brackets formed of different materials. The brackets of the present invention are elongated for additional support, this added reinforcement helps to avoid any dislodging/sagging of the gutters that occurs when a buildup of debris or rain water has accumulated.

The hangers/brackets of the gutters are transparent and are elongated for added support to reinforce the sustainability of the gutter when connected to the house/building and avoid any sagging or dislodging of the gutter. The downspouts are accompanied by elbows that consist of access points to ensure easy access to the most vulnerable parts of the downspouts that are prone to clogging.

The gutter system of the present invention further comprises an easy to assemble feature. For example, one side of the downspout will have a female adapter while the other side has a male adapter which allows the downspouts to be easily screwed together to facilitate an easy set-up/disassembly process, or two male adapting sides with a middle component connecting the two sides to each other.

Whenever the homeowners experience a backup, they can either simply clean it themselves, which saves them money, or call a professional. The present system makes disassembly and cleaning of the blocked area easier even for the professionals, therefore, reducing cost to the homeowner. This method also avoids any water seepage through the borders of each of the downspouts and avoids dirty water running down the external part of the spout and potentially staining it. This makes it easier and simpler for the homeowners to take care of their downspouts.

The gutter system of the invention can be optionally used in conjunction with a leaf guard or a screen, known in the art, to minimize the entry of debris into to the gutter.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

With respect to the above description, it is to be realized that the optimum relationships for the parts of the invention in regard to size, shape, form, materials, function and manner of operation, assembly and use are deemed readily apparent and obvious to those skilled in the art, and all equivalent relationships to those illustrated in the drawings and described in the specification are intended to be encompassed by the present invention.

What is claimed is:

1. A gutter system for monitoring of debris in a gutter trough and a downspout trough each of said gutter trough and downspout trough being positioned proximate to a building, said gutter system comprising:

a. the gutter trough positioned near-horizontally in relation to the building such that sections of the gutter trough are positioned proximate to one of the one or more side-walls of the building, the gutter trough incorporating three walls including a gutter-base-wall that is connected on its front facing side to a gutter-front-wall and on its opposite a rear facing side to a gutter-rear-wall, said gutter-front-wall and said gutter-base-wall each incorporating a longitudinal gap with a longitudinal transparent section positioned over or within said longitudinal gap;

b. one or more downspout troughs, each downspout trough incorporating four walls including a downspout-front-wall positioned opposite to a downspout-rear-wall and being connected to each of two downspout-side-walls that are positioned opposite to each other, the four walls forming an elongate trough, at least one of said downspout-side-walls incorporating a longitudinal transparent section, and said downspout troughs each having the downspout-rear-wall positioned proximate to one of the side walls of the building and the downspout troughs each being attached to one of the side-walls of the building; and c. a plurality of downspout elbows, at least one of such plurality of downspout elbows connecting said gutter trough to one of said one or more downspout troughs, whereby flow of rainwater and debris is navigated along at least a portion of the gutter trough through the downspout elbow connected to the gutter trough, to the downspout trough connected to the downspout elbow, and through the downspout trough towards a ground surface.

2. The gutter system of claim 1, wherein each of the plurality of downspout elbows:

a. incorporates four walls including an elbow-front-wall positioned opposite an elbow-rear-wall and being connected to each of two elbow-side-walls that are positioned opposite to each other; and b. incorporates a transparent section, whereby the downspout elbow can be monitored for build-up of debris occurring in the interior space of the downspout elbow.

3. The gutter system of claim 1, wherein each of the plurality of downspout elbows is formed of a transparent material, such that the transparent section encompasses the whole of the downspout elbow.

4. The gutter system of claim 1, wherein each of the plurality of downspout elbows has an access point whereby an interior space of the downspout elbow is accessible, whereby unclogging of a clog in the downspout elbow is achieved.

5. The gutter system of claim 4, wherein the access point incorporates an opening in one of the walls of the downspout elbow and a removable cap configured to fit over the opening and that is attachable to the opening by way of a screw connection between the opening and the cap to thereby close the opening.

6. The gutter system of claim 1, wherein said building is any of the following: a residential building, a house, or a commercial building.

7. The gutter system of claim 1, wherein the transparent section incorporated in the gutter trough is configured as one or more transparent strips incorporated in any of: the gutter-front-wall or the gutter-base-wall.

8. The gutter system of claim 1, wherein the transparent section incorporated in either one of or both of the gutter-front-wall and the gutter-base-wall encompasses the whole thereof.

9. The gutter system of claim 1, wherein the transparent section incorporated in the gutter-front wall and the gutter-base-wall is configured as one or more transparent strips therein.

10. The gutter system of claim 1, wherein the transparent section incorporated in the downspout trough is configured so that the whole of the downspout trough is formed of a transparent material.

11. The gutter system of claim 1, wherein the longitudinal transparent section of the downspout trough is configured as one or more transparent strips incorporated in one or more of the downspout-front-wall, the downspout-rear-wall and the downspout-side-walls.

12. The gutter system of claim 1, wherein a plurality of transparent elongated brackets or hangers are connected to one of one or more of the side-walls of the building or fascia-board and the gutter trough is supported in proximity to the building by the plurality of transparent elongated brackets or hangers.

13. The gutter system of claim 12, wherein each of the elongated brackets or hangers incorporates an horizontally extended front grabbing section operable to grab an area of the gutter-front-wall, whereby support of the gutter trough is reinforced and sagging or dislodging of the gutter systems in proximity to the building is deterred.

14. The gutter system of claim 1, wherein the gutter system is formed of a material that is one of the following: metal plastic, glass, or aluminum.

15. The gutter system of claim 1, wherein the gutter system is formed of a material that is a combination of plastic and glass.

16. The gutter system of claim 1, wherein the gutter system is formed of a material that is one of the following: polycarbonate or polyacrylate.

17. A gutter system for monitoring of rainwater flow and debris in a gutter trough, at least one downspout trough, and at least one downspout elbow positioned proximate to a building, said gutter system comprising:

a. the gutter trough positioned near-horizontally in relation to the building such that sections of the gutter trough are positioned proximate to one of the one or more side-walls of the building, the gutter trough incorporating three walls including a gutter-base-wall that is connected on its front facing side to a gutter-front-wall and on its opposite side rear facing side to a gutter-rear-wall, said gutter-front-wall and said gutter-base-wall each incorporating a longitudinal gap with a longitudinal transparent section positioned over or within said longitudinal gap;

b. one or more downspout troughs, each downspout trough incorporating four walls including a downspout-front-wall positioned opposite to a downspout-rear-wall and being connected to each of two downspout-side-walls that are positioned opposite to each other, the four walls forming an elongate trough, at least one of said downspout-side-walls incorporating a longitudinal transparent section, and said downspout troughs each having the downspout-rear-wall positioned proximate to one of the side-walls of the building and the downspout troughs each being attached to one of the side-walls of the building;

c. a plurality of downspout elbows, at least one of such plurality of downspout elbows connecting said gutter trough to one of said one or more downspout troughs, each downspout elbow incorporating four walls including an elbow-front-wall positioned opposite an elbow-rear-wall and being connected to each of two elbow-side-walls that are positioned opposite to each other, and further incorporating a transparent section in at least one of the four walls;

d. an access point incorporated in at least one of the plurality of downspout elbows comprising an opening incorporated in one of the walls of the downspout elbow and a removable cap configured to fit over the opening being attachable to the opening by way of a screw connection between the opening and the cap to thereby close the opening; and e. a plurality of transparent elongated brackets each incorporating a grabbing section operable to grab an area of the gutter-front-wall, and each connected to one of the side-walls of the building, and the gutter trough being supported in proximity to the building by said plurality of transparent elongated brackets; and whereby rainwater flow is navigated along at least a portion of the gutter trough through the downspout elbow connected to the gutter trough, to the downspout trough connected to the downspout elbow, and through the downspout trough towards a ground surface.

18. The gutter system of claim 17, wherein the building is any of the following: a residential building, a house, or a commercial building.

19. The gutter system of claim 17, wherein the plurality of transparent elongated brackets are hangers, and said hangers are connected to one of one or more side-walls of the building or fascia-board.

* * * * *